US010309675B2

(12) United States Patent
Yang et al.

(10) Patent No.: US 10,309,675 B2
(45) Date of Patent: Jun. 4, 2019

(54) DEFROSTING METHOD FOR AIR CONDITIONER AND DEFROSTING DEVICE FOR AIR CONDITIONER

(71) Applicants: GD MIDEA HEATING & VENTILATING EQUIPMENT CO., LTD., Foshan (CN); MIDEA GROUP CO., LTD., Foshan (CN)

(72) Inventors: Guozhong Yang, Foshan (CN); Fudang Wei, Foshan (CN); Yuanyang Li, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/500,188

(22) PCT Filed: Jun. 26, 2015

(86) PCT No.: PCT/CN2015/082544
§ 371 (c)(1),
(2) Date: Jan. 30, 2017

(87) PCT Pub. No.: WO2016/187923
PCT Pub. Date: Dec. 1, 2016

(65) Prior Publication Data

US 2018/0209677 A1 Jul. 26, 2018

(30) Foreign Application Priority Data

May 22, 2015 (CN) ..... 2015 1 0268505

(51) Int. Cl.
*F24F 11/42* (2018.01)
*F25B 47/02* (2006.01)
(Continued)

(52) U.S. Cl.
CPC ..... *F24F 11/42* (2018.01); *F24F 11/63* (2018.01); *F24F 11/871* (2018.01); *F25B 47/02* (2013.01);
(Continued)

(58) Field of Classification Search
CPC ..... F25B 47/02; F25B 47/025; F25B 47/022; F25D 21/006; B60L 1/003;
(Continued)

(56) References Cited

U.S. PATENT DOCUMENTS 4,563,877 A * 1/1986 Harnish ..... F25D 21/002 62/156
5,095,711 A 3/1992 Marris et al.
(Continued)

FOREIGN PATENT DOCUMENTS

CN 1532483 A 9/2004
CN 102197269 A 9/2011
(Continued)

OTHER PUBLICATIONS

Chinese Patent Application No. 201510268505.0, First Office Action dated Mar. 23, 2017, with English translation, 15 pages.
(Continued)

*Primary Examiner* — Emmanuel E Duke
(74) *Attorney, Agent, or Firm* — Lathrop Gage LLP

(57) ABSTRACT

The present disclosure provides a defrosting method for an air conditioner. The method includes: acquiring outdoor temperature and outdoor humidity if the air conditioner enters a defrosting mode; judging whether the outdoor temperature and the outdoor humidity satisfy a predetermined condition; and controlling an outdoor fan to rotate reversely according to tube temperature of an outdoor heat exchanger and a defrosting period, so as to defrost a protecting housing surrounding the outdoor heat exchanger if it
(Continued)

is judged that the outdoor temperature and the outdoor humidity satisfy the predetermined condition. The defrosting method may efficiently defrost the protecting housing surrounding the outdoor heat exchanger completely. The present disclosure further provides a defrosting device for an air conditioner.

9 Claims, 3 Drawing Sheets

(51) Int. Cl.

| | |
|---|---|
| ***F24F 11/871*** | (2018.01) |
| ***F24F 11/63*** | (2018.01) |
| *F24F 110/12* | (2018.01) |
| *F24F 110/22* | (2018.01) |
| *F24F 130/10* | (2018.01) |

(52) U.S. Cl.
CPC ..... *F24F 2110/12* (2018.01); *F24F 2110/22* (2018.01); *F24F 2130/10* (2018.01)

(58) Field of Classification Search
CPC ..... B60H 1/00785; F24F 3/1423; F24F 11/42; F24F 11/63; F24F 11/871; F24F 2110/22; F24F 2130/10; F24F 2110/12
See application file for complete search history.

(56) References Cited

U.S. PATENT DOCUMENTS

| | | | | |
|---|---|---|---|---|
| 2007/0144187 | A1* | 6/2007 | Lee | F25B 47/025 62/155 |
| 2007/0180838 | A1* | 8/2007 | Shah | F25D 21/008 62/150 |
| 2011/0209488 | A1* | 9/2011 | Yamada | F24F 1/06 62/151 |
| 2013/0079978 | A1* | 3/2013 | Uyeki | B60H 1/00657 701/36 |
| 2015/0218772 | A1 | 8/2015 | Shin | |
| 2015/0300723 | A1* | 10/2015 | Tsukino | F25B 47/025 62/128 |

FOREIGN PATENT DOCUMENTS

| | | | | |
|---|---|---|---|---|
| CN | 102829527 | A | * 12/2012 | |
| CN | 102829527 | A | 12/2012 | |
| CN | 104006449 | A | * 8/2014 | |
| CN | 104006449 | A | 8/2014 | |
| CN | 104236004 | A | 12/2014 | |
| CN | 104344470 | A | 2/2015 | |
| CN | 104515330 | A | * 4/2015 | F24F 11/30 |
| CN | 104515330 | A | 4/2015 | |
| JP | S60169038 | A | 9/1985 | |
| JP | S63183335 | A | 7/1988 | |
| JP | 2013217506 | A | 10/2013 | |
| KR | 100779539 | B1 | 11/2007 | |
| KR | 100963565 | B1 | 6/2010 | |
| KR | 20100121867 | A | 11/2010 | |

OTHER PUBLICATIONS

European Patent Application No. 16192395.8 Extended Search and Opinion dated Apr. 5, 2017, 5 pages.
PCT/CN2015/082544 English translation of the International Search Report, dated Feb. 15, 2016, 3 pages.
European Patent Application No. 15893004.0 extended Search and Opinion dated Mar. 6, 2018, 8 pages.

* cited by examiner

DEFROSTING METHOD FOR AIR CONDITIONER AND DEFROSTING DEVICE FOR AIR CONDITIONER

CROSS-REFERENCE TO RELATED APPLICATIONS

This application is a U.S. national phase application based up an International Application No. PCT/CN2015/082544, filed on Jun. 26, 2016, the entire contents of which are incorporated herein by reference.

FIELD

The present disclosure relates to the field of air conditioner technology, and more particularly to a defrosting method for an air conditioner and a defrosting device for an air conditioner.

BACKGROUND

In the related arts, a control method based on temperature and a period is mainly used for defrosting an air conditioner. That is, under a heating mode, if tube temperature of an outdoor heat exchanger is lower than a specific value while satisfying a period condition, the air conditioner is controlled to enter a defrosting mode. If the tube temperature of the outdoor heat exchanger increases to another specific value while satisfying another period condition, the air conditioner is controlled to exit from the defrosting mode and to start the heating mode again.

The control method may defrost outside surfaces of the outdoor heat exchanger. However, for a case that there is a protecting housing surrounding the outdoor heat exchanger, the control method may have some troubles. For example, as a separation distance between the protecting housing and the outdoor heat exchanger is improper or as there is an installation error, frosting extends to the protecting housing from the outdoor heat exchanger such that defrosting is incompletely.

SUMMARY

Embodiments of an aspect of the present disclosure provide a defrosting method for an air conditioner. The method includes: acquiring outdoor temperature and outdoor humidity if the air conditioner enters a defrosting mode; judging whether the outdoor temperature and the outdoor humidity satisfy a predetermined condition; and controlling an outdoor fan to rotate reversely according to tube temperature of an outdoor heat exchanger and a defrosting period, so as to defrost a protecting housing surrounding the outdoor heat exchanger if it is judged that the outdoor temperature and the outdoor humidity satisfy the predetermined condition.

Embodiments of another aspect of the present disclosure provide a defrosting device for an air conditioner. The device includes: a processing component; and a memory, configured to store an instruction executable by the processing component; in which the processing component is configured to: acquire outdoor temperature and outdoor humidity if the air conditioner enters a defrosting mode; judge whether the outdoor temperature and the outdoor humidity satisfy a predetermined condition; and control an outdoor fan to rotate reversely according to tube temperature of an outdoor heat exchanger and a defrosting period, so as to defrost a protecting housing surrounding the outdoor heat exchanger, if it is judged that the outdoor temperature and the outdoor humidity satisfy the predetermined condition.

Embodiments of still another aspect of the present disclosure provide an air conditioner including a defrosting device for an air conditioner, which includes a processing component; and a memory, configured to store an instruction executable by the processing component; in which the processing component is configured to: acquire outdoor temperature and outdoor humidity if the air conditioner enters a defrosting mode; judge whether the outdoor temperature and the outdoor humidity satisfy a predetermined condition; and control an outdoor fan to rotate reversely according to tube temperature of an outdoor heat exchanger and a defrosting period, so as to defrost a protecting housing surrounding the outdoor heat exchanger, if it is judged that the outdoor temperature and the outdoor humidity satisfy the predetermined condition.

Figure 1:
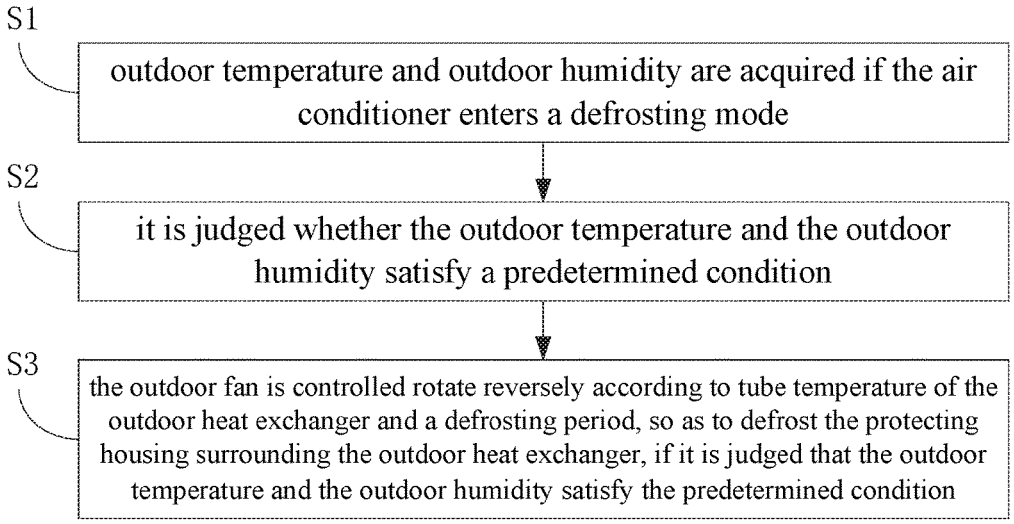
FIG. 1 is a flow chart showing a defrosting method for an air conditioner according to embodiments of the present disclosure.

Reference numerals: acquiring module 10, controlling module 20, air conditioner 1, compressor 11, four-way valve 12, outdoor heat exchanger 13, protecting housing 14, and defrosting device 15.

DETAILED DESCRIPTION

Descriptions will be made in detail to embodiments of the present disclosure, examples of the embodiments are shown in drawings, in which the same or similar elements and the elements having same or similar functions are denoted by like reference numerals throughout the descriptions. The embodiments described herein with reference to drawings are explanatory, are intended to understand the present disclosure, and are not construed to limit the present disclosure.

The defrosting method for an air conditioner 1 and the defrosting device 15 for an air conditioner 1 provided in embodiments of the present disclosure will be described referring to the drawings.

FIG. 1 is a flow chart showing a defrosting method for an air conditioner 1 according to embodiments of the present disclosure. As shown in FIG. 1, the method includes followings.

S1, outdoor temperature and outdoor humidity are acquired if the air conditioner 1 enters a defrosting mode.

S2, it is judged whether the outdoor temperature and the outdoor humidity satisfy a predetermined condition.

According to an embodiment of the present disclosure, it is judged that the outdoor temperature and the outdoor humidity satisfy the predetermined condition, if the outdoor temperature is lower than first preset temperature and the outdoor humidity is higher than first preset humidity. The first preset temperature and the first preset humidity may be standardized according to an actual condition. Preferably, the first preset temperature may be 2 degree centigrade (° C.) and the first preset humidity is 85 percent (%).

According to another embodiment of the present disclosure, before the outdoor temperature and the outdoor humidity are acquired, information of current weather is also acquired. If the current weather is at least one of raining and snowing, it is judged that the outdoor temperature and the outdoor humidity satisfy the predetermined condition when the outdoor temperature is lower than the first preset temperature and the outdoor humidity is higher than the first preset humidity. And if the current weather is neither the raining nor the snowing, it is judged that the outdoor temperature and the outdoor humidity satisfy the predetermined condition when the outdoor temperature is lower than second preset temperature and the outdoor humidity is higher than second preset humidity, in which the second preset temperature is higher than the first preset temperature and the second preset humidity is lower than the first preset humidity. The first preset temperature, the first preset humidity, the second preset temperature and the second preset humidity may be standardized according to the actual condition. Preferably, the first preset temperature may be 2 degree centigrade, the first preset humidity is 85 percent, the second preset temperature may be 5 degree centigrade and the second preset humidity is 75 percent.

Specifically, a communicating component (such as a WIFI communicating component) may be included in an outdoor machine of the air conditioner 1 such that the information of current weather is acquired by receiving meteorological information reported by weather bureau via the communicating component. Conditions to which an outdoor fan rotates reversely according vary with information of the current weather.

If the current weather is at least one of raining and snowing, it is judged that the outdoor temperature T and the outdoor humidity H satisfy the predetermined condition when the outdoor temperature T<the first preset temperature $T_1$ (such as 2 degree centigrade) and the outdoor humidity H>the first preset humidity $H_1$ (such as 85 percent), then the outdoor fan needs to rotate reversely. If the current weather is neither the raining nor the snowing, it is judged that the outdoor temperature T and the outdoor humidity H satisfy the predetermined condition when the outdoor temperature T<the second preset temperature $T_2$ (such as 5 degree centigrade) and the outdoor humidity H>the second preset humidity $H_2$ (such as 75 percent), then the outdoor fan needs to rotate reversely.

If the communication component fails or there is not any communication components included in the outdoor machine, it is judged whether the outdoor temperature and the outdoor humidity satisfy the predetermined condition directly according to a condition the current weather is at least one of raining and snowing.

S3, the outdoor fan is controlled to rotate reversely according to tube temperature of the outdoor heat exchanger 13 and a defrosting period, so as to defrost a protecting housing 14 surrounding the outdoor heat exchanger 13 if it is judged that the outdoor temperature and the outdoor humidity satisfy the predetermined condition.

In some embodiments of the present disclosure, controlling the outdoor fan to rotate reversely according to the tube temperature of the outdoor heat exchanger 13 and the defrosting period specifically includes: controlling the outdoor fan to rotate reversely if the tube temperature is higher than a difference between preset temperature for exiting from the defrosting mode and a first temperature threshold; or controlling the outdoor fan to rotate reversely if the defrosting period reaches a difference between a preset defrosting period and a first period threshold.

The preset temperature for exiting from the defrosting mode, the first temperature threshold, the preset defrosting period and the first period threshold may be standardized according to the actual condition. Preferably, the first temperature threshold may be 10 degree centigrade and the first period threshold may be 2 minutes (min for short).

According to an embodiment of the present disclosure, if it is judged that the outdoor temperature and the outdoor humidity do not satisfy the predetermined condition, the air conditioner 1 is controlled to exit from the defrosting mode when the tube temperature of the outdoor heat exchanger 13 is higher than the preset temperature for exiting from the defrosting mode or the defrosting period reaches the preset defrosting period.

Specifically, if the outdoor temperature T and the outdoor humidity H satisfy the predetermined condition, the start moment of rotating reversely for the outdoor fan is determined according to the tube temperature of the outdoor heat exchanger 13 and the defrosting period. That is, it is judged whether the tube temperature $T_w$ of the outdoor heat exchanger 13 is higher than the difference between the preset temperature $T_{w1}$ for exiting from the defrosting mode and the first temperature threshold $T_{w2}$, or it is judged whether the defrosting period t reaches the difference between the preset defrosting period $t_1$ and the first period threshold $t_2$. If the tube temperature $T_w$ of the outdoor heat exchanger 13>the difference between the preset temperature $T_{w1}$ (such as 18 degree centigrade) for exiting from the defrosting mode and the first temperature threshold $T_{w2}$ (such as 10 degree centigrade), or the defrosting period t>the difference between the preset defrosting period $t_1$ (such as 10 min) and the first period threshold $t_2$ (such as 2 min), that is if the tube temperature $T_w$ of the outdoor heat exchanger 13 reaches 8 degree centigrade or the defrosting period t reaches 8 min, the outdoor fan is controlled to rotate reversely. Preferably, the period of rotating reversely for the outdoor fan may be 2 min, and the air conditioner 1 exits from the defrosting mode if the period of rotation reversely for the outdoor fan reaches 2 min.

If the outdoor temperature T and the outdoor humidity H do not satisfy the predetermined condition, it does not need to control the outdoor fan to rotate reversely. Then the defrosting is performed via a conventional defrosting method and the air conditioner 1 is controlled to exit from the defrosting mode if the tube temperature $T_w$ of the outdoor heat exchanger 13 is higher than the preset temperature $T_{w1}$ for exiting from the defrosting mode or the defrosting period t reaches the preset defrosting period $t_1$.

Specifically, if being in a heating mode, the air conditioner 1 is controlled to enter the defrosting mode when the tube temperature of the outdoor heat exchanger 13 is lower than a specific value for a period or satisfies a timing defrosting condition. After the air conditioner 1 enters the defrosting mode, the outdoor temperature and the outdoor humidity are acquired and it is judged whether the outdoor temperature and the outdoor humidity satisfy the predetermined condition. If the outdoor temperature and the outdoor humidity satisfy the predetermined condition, after the defrosting mode is performed for a period, that is to say, when the tube temperature of the outdoor heat exchanger 13 is higher than the difference between the preset temperature for exiting from the defrosting mode and the first temperature threshold, or the defrosting period reaches the difference between the preset defrosting period and the first period threshold, the outdoor fan is controlled to rotate reversely. Outdoor air is heated while flowing through the outdoor heat exchanger 13 when the outdoor fan is rotating reversely. Then the outdoor air heated flows through the protecting housing 14 surrounding the outdoor heat exchanger 13, which may efficiently defrost the protecting housing 14 completely. The air conditioner 1 exits from the defrosting mode after the outdoor fan rotates reversely for a period. If the outdoor temperature and the outdoor humidity do not satisfy the predetermined condition, the defrosting is performed according to the conventional defrosting method.

Figure 2:
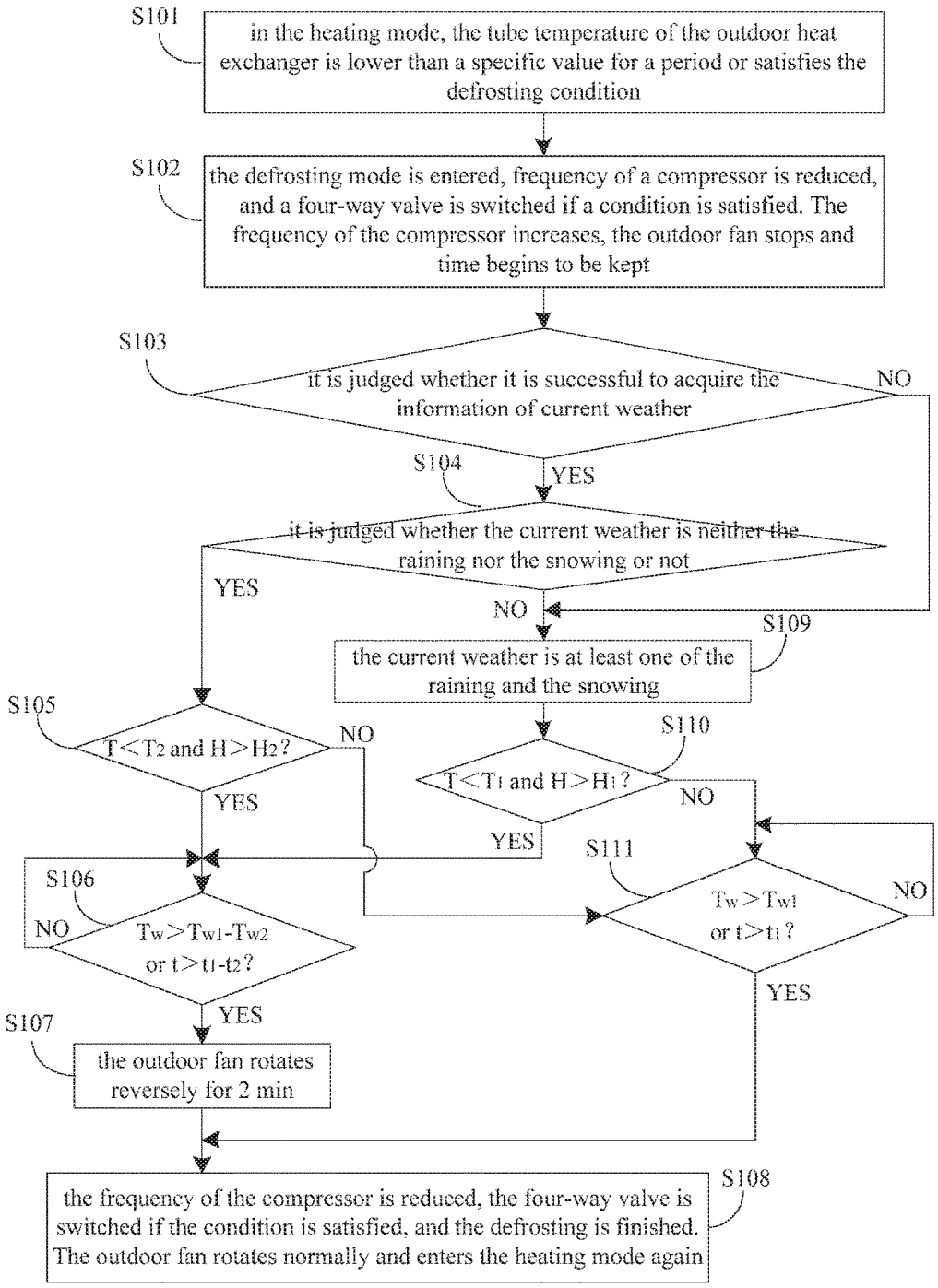
FIG. 2 is a flow chart showing a defrosting method for an air conditioner according to an embodiment of the present disclosure.

Further, according to a specific embodiment of the present disclosure, shown as FIG. 2, a process of defrosting the air conditioner 1 includes followings.

S101, in the heating mode, the tube temperature of the outdoor heat exchanger 13 is lower than a specific value for a period or satisfies the timing defrosting condition.

S102, the defrosting mode is entered, frequency of a compressor 11 is reduced, and a four-way valve 12 is switched if a preset condition is satisfied. The frequency of the compressor 11 increases, the outdoor fan stops and time begins to be kept.

S103, it is judged whether it is successful to acquire the information of the current weather. S104 is performed if yes, and S109 is performed if no.

S104, it is judged whether the current weather is neither the raining nor the snowing or not. S105 is performed if yes, and S109 is performed if no.

S105, it is judged whether the outdoor temperature T is lower than the second preset temperature $T_2$ and the outdoor humidity H is higher than the second preset humidity $H_2$. S106 is performed if yes, and S111 is performed if no.

S106, it is judged whether the tube temperature $T_w$ is higher than the difference between the preset temperature $T_{w1}$ for exiting form the defrosting mode and the first temperature threshold $T_{w2}$, or the defrosting period t is longer than the difference between the preset defrosting period $t_1$ and the first period threshold $t_2$. S107 is performed if yes, and S106 is returned to if no.

S107, the outdoor fan rotates reversely for 2 min.

S108, the frequency of the compressor 11 is reduced, the four-way valve 12 is switched if the preset condition is satisfied, and the defrosting is finished. The outdoor fan rotates normally and enters the heating mode again.

S109, the current weather is at least one of the raining and the snowing.

S110, it is judged whether the outdoor temperature T is lower than the first preset temperature $T_1$ and the outdoor humidity H is higher than the first preset humidity $H_1$. S106 is returned to if yes, and S111 is performed if no.

S111, it is judged whether the tube temperature $T_w$ of the outdoor heat exchanger 13 is higher than the preset temperature $T_{w1}$ for exiting from the defrosting mode, or the defrosting period t is longer than the preset defrosting period $t_1$. S108 is returned to if yes, and S111 is returned to perform a judgement again if no.

In a conclusion, with the defrosting method for an air conditioner 1 according to embodiments of the present disclosure, the outdoor temperature and the outdoor humidity are acquired firstly if the air conditioner 1 enters the defrosting mode, and it is judged whether the outdoor temperature and the outdoor humidity satisfy the predetermined condition. The outdoor fan is controlled to rotate conversely according to the tube temperature of the outdoor heat exchanger 13 and the defrosting period, so as to defrost the protecting housing 14 surrounding the outdoor heat exchanger 13, if the outdoor temperature and the outdoor humidity satisfy the predetermined condition, thereby efficiently defrosting the protecting housing 14 completely.

Figure 3:
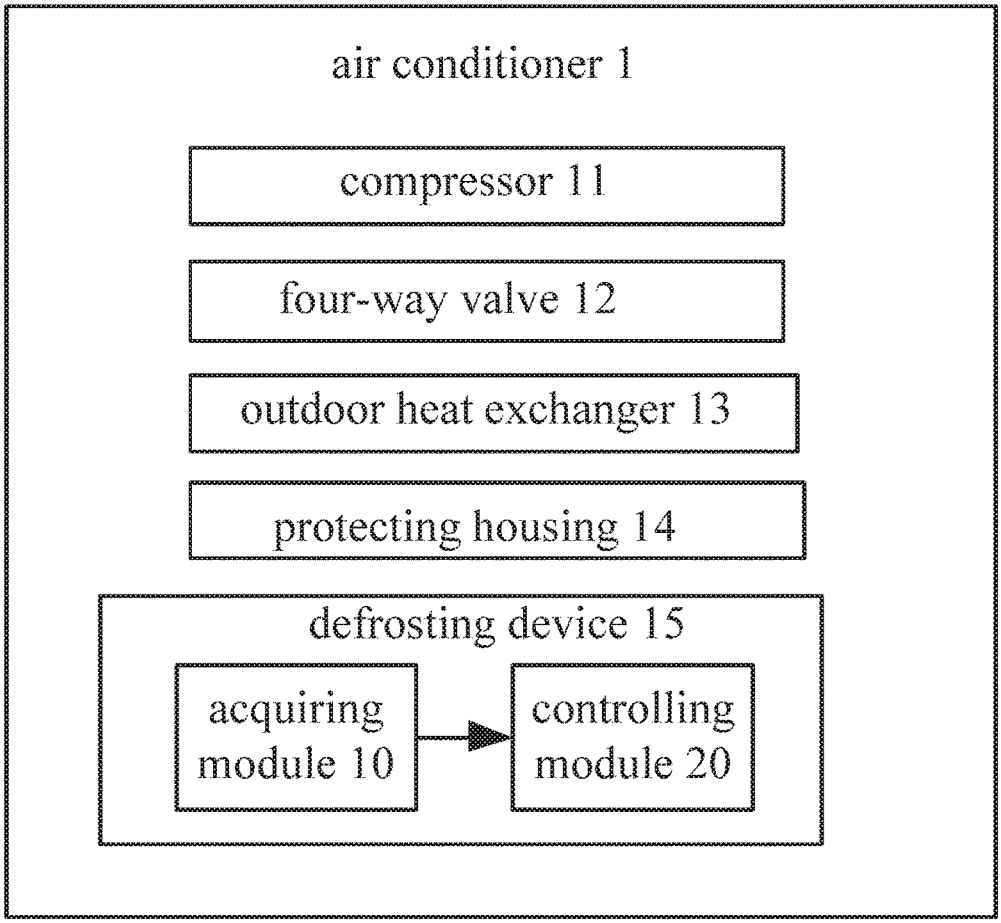
FIG. 3 is a block diagram illustrating a defrosting device for an air conditioner according to embodiments of the present disclosure.

FIG. 3 is a block diagram illustrating a defrosting device 15 for an air conditioner 1 according to embodiments of the present disclosure. Shown as FIG. 3, the device includes an acquiring module 10 and a controlling module 20.

The acquiring module 10 is configured to acquire outdoor temperature and outdoor humidity if the air conditioner 1 enters a defrosting mode. The controlling module 20 is configured to judge whether the outdoor temperature and the outdoor humidity satisfy a predetermined condition, and to control an outdoor fan to rotate reversely according to tube temperature of an outdoor heat exchanger 13 and a defrosting period, so as to defrost a protecting housing 14 surrounding the outdoor heat exchanger 13, if judging that the outdoor temperature and the outdoor humidity satisfy the predetermined condition.

According to an embodiment of the present disclosure, the controlling module 20 judges that the outdoor temperature and the outdoor humidity satisfy the predetermined condition if the outdoor temperature is lower than first preset temperature and the outdoor humidity is higher than first preset humidity. Preferably, the first preset temperature may be 2 degree centigrade and the first preset humidity is 85 percent.

According to another embodiment of the present disclosure, before the acquiring module 10 acquires the outdoor temperature and the outdoor humidity, the acquiring module 10 is further configured to acquire information of current weather. If the current weather is at least one of raining and snowing, the controlling module 20 judges that the outdoor temperature and the outdoor humidity satisfy the predetermined condition when the outdoor temperature is lower than the first preset temperature and the outdoor humidity is higher than the first preset humidity. And if the current weather is neither the raining nor the snowing, the controlling module 20 judges that the outdoor temperature and the outdoor humidity satisfy the predetermined condition when the outdoor temperature is lower than second preset temperature and the outdoor humidity is higher than second preset humidity, in which the second preset temperature is higher than the first preset temperature and the second preset humidity is lower than the first preset humidity. Preferably, the first preset temperature may be 2 degree centigrade, the first preset humidity is 85 percent, the second preset temperature may be 5 degree centigrade and the second preset humidity is 75 percent.

Specifically, a communicating component (such as a WIFI communicating component) may be included in the acquiring module 10, such that the acquiring module 10 may acquire the information of the current weather by receiving meteorological information reported by weather bureau via the communicating component. Conditions to which the outdoor fan rotates reversely according vary with information of the current weather.

If the acquiring module 10 acquires that the current weather is at least one of raining and snowing, the controlling module 20 judges that the outdoor temperature T and the outdoor humidity H satisfy the predetermined condition when the outdoor temperature T<the first preset temperature $T_1$ (such as 2 degree centigrade) and the outdoor humidity H>the first preset humidity $H_1$ (such as 85 percent), then the outdoor fan needs to rotate reversely. If the acquiring module 10 acquires that the current weather is neither the raining nor the snowing, the controlling module 20 judges that the outdoor temperature T and the outdoor humidity H satisfy the predetermined condition when the outdoor temperature T<the second preset temperature $T_2$ (such as 5 degree centigrade) and the outdoor humidity H>the second preset humidity $H_2$ (such as 75 percent), then the outdoor fan needs to rotate reversely.

If the communication component fails or there is not any communication components included in the outdoor machine, the controlling module 20 may directly judge whether the outdoor temperature and the outdoor humidity satisfy the predetermined condition according to a condition that the current weather is at least one of raining and snowing.

In some embodiments of the present disclosure, the controlling module 20 controls the outdoor fan to rotate reversely if the tube temperature of the outdoor heat exchanger 13 is higher than a difference between preset temperature for exiting from the defrosting mode and a first temperature threshold; or the controlling module 20 controls the outdoor fan to rotate reversely if the defrosting period reaches a difference between a preset defrosting period and a first period threshold. Preferably, the first temperature threshold may be 10 degree centigrade and the first period threshold may be 2 min.

According to an embodiment of the present disclosure, if the controlling module 20 judges that the outdoor temperature and the outdoor humidity do not satisfy the predetermined condition, the controlling module 20 controls the air conditioner 1 to exit from the defrosting mode when the tube temperature of the outdoor heat exchanger 13 is higher than the preset temperature for exiting from the defrosting mode or the defrosting period reaches the preset defrosting period.

Specifically, if the outdoor temperature T and the outdoor humidity H satisfy the predetermined condition, the controlling module 20 determines the start moment of rotating reversely for the outdoor fan according to the tube temperature of the outdoor heat exchanger 13 and the defrosting period. That is, the controlling module 20 judges whether the tube temperature $T_w$ of the outdoor heat exchanger 13 is higher than the difference between the preset temperature $T_{w1}$ for exiting from the defrosting mode and the first temperature threshold $T_{w2}$, or the controlling module 20 judges whether the defrosting period t reaches the difference between the preset defrosting period $t_1$ and the first period threshold $t_2$. If the tube temperature $T_w$ of the outdoor heat exchanger 13>the difference between the preset temperature $T_{w1}$ (such as 18 degree centigrade) for exiting from the defrosting mode and the first temperature threshold $T_{w2}$ (such as 10 degree centigrade), or the defrosting period t>the difference between the preset defrosting period $t_1$ (such as 10 min) and the first period threshold $t_2$ (such as 2 min), that is if the tube temperature $T_w$ of the outdoor heat exchanger 13 reaches 8 degree centigrade or the defrosting period t reaches 8 min, the controlling module 20 controls the outdoor fan to rotate reversely. Preferably, the period of rotating reversely for the outdoor fan may be 2 min, and the controlling module 20 controls the air conditioner 1 to exit from the defrosting mode if the period of rotation reversely for the outdoor fan reaches 2 min.

If the outdoor temperature T and the outdoor humidity H do not satisfy the predetermined condition, the controlling module 20 does not need to control the outdoor fan to rotate reversely. Then the defrosting is performed via a conventional defrosting method and the controlling module 20 controls the air conditioner 1 to exit from the defrosting mode if the tube temperature $T_w$ is higher the preset temperature $T_{w1}$ for exiting from the defrosting mode or the defrosting period t reaches the preset defrosting period $t_1$.

Specifically, shown as FIG. 2, if being in a heating mode, the air conditioner 1 is controlled to enter the defrosting mode if the tube temperature of the outdoor heat exchanger 13 is lower than a specific value for a period or satisfies a timing defrosting condition. After the air conditioner 1 enters the defrosting mode, the acquiring module 10 acquires the outdoor temperature and the outdoor humidity and the controlling module 20 judges whether the outdoor temperature and the outdoor humidity satisfy the predetermined condition. If the outdoor temperature and the outdoor humidity satisfy the predetermined condition, after the defrosting mode is performed for a period, that is to say, if the tube temperature of the outdoor heat exchanger 13 is higher than the difference between the preset temperature for exiting from the defrosting mode and the first temperature threshold, or the defrosting period reaches the difference between the preset defrosting period and the first period threshold, the controlling module 20 controls the outdoor fan to rotate reversely. Outdoor air is heated while flowing through the outdoor heat exchanger 13 when the outdoor fan is rotating reversely. Then the outdoor air heated flows through the protecting housing 14 surrounding the outdoor heat exchanger 13, which may efficiently defrost the protecting housing 14 completely. The controlling module 20 controls the air conditioner 1 to exit from the defrosting mode after the outdoor fan rotates reversely for a period. If the outdoor temperature and the outdoor humidity do not satisfy the predetermined condition, the defrosting is performed according to the conventional defrosting method.

With the defrosting device 15 according to embodiments of the present disclosure, the acquiring module acquires the outdoor temperature and the outdoor humidity if the air conditioner 1 enters the defrosting mode, and then the controlling module judges whether the outdoor temperature and the outdoor humidity satisfy the predetermined condition. The controlling module controls the outdoor fan to rotate conversely according to the tube temperature of the outdoor heat exchanger 13 and the defrosting period, so as to defrost the protecting housing 14 surrounding the outdoor heat exchanger 13, if judging that the outdoor temperature and the outdoor humidity satisfy the predetermined condition, thereby efficiently defrosting the protecting housing 14 completely.

In the description of the present disclosure, it is to be understood that, terms such as "center", "longitudinal", "lateral", "length", "width", "thickness", "over", "below", "front", "back", "left", "right", "vertical", "horizontal", "top", "bottom", "in", "out", "clockwise", "anti-clockwise", "axial", "radial" and "circumference" refer to the directions and location relations which are the directions and location relations shown in the drawings, and for describing the present disclosure and for describing in simple, and which are not intended to indicate or imply that the device or the elements are disposed to locate at the specific directions or are structured and performed in the specific directions, which could not to be understood to the limitation of the present disclosure.

In addition, terms such as "first" and "second" are used herein for purposes of description and are not intended to indicate or imply relative importance or significance. Furthermore, the feature defined with "first" and "second" may comprise one or more this feature distinctly or implicitly. In the description of the present disclosure, "a plurality of" means two or more than two, unless specified otherwise.

In the present disclosure, unless specified or limited otherwise, the terms "mounted," "connected," "coupled" and "fixed" are understood broadly, such as fixed, detachable mountings, connections and couplings or integrated, and can be mechanical or electrical mountings, connections and couplings, and also can be direct and via media indirect mountings, connections, and couplings, and further can be inner mountings, connections and couplings of two components or interaction relations between two components, which can be understood by those skilled in the art according to the detail embodiment of the present disclosure.

In the present disclosure, unless specified or limited otherwise, the first characteristic is "on" or "under" the second characteristic refers to the first characteristic and the second characteristic can be direct or via media indirect mountings, connections, and couplings. And, the first characteristic is "on", "above", "over" the second characteristic may refer to the first characteristic is right over the second characteristic or is diagonal above the second characteristic, or just refer to the horizontal height of the first characteristic is higher than the horizontal height of the second characteristic. The first characteristic is "below" or "under" the second characteristic may refer to the first characteristic is right over the second characteristic or is diagonal under the second characteristic, or just refer to the horizontal height of the first characteristic is lower than the horizontal height of the second characteristic.

In the description of the present disclosure, reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Without a contradiction, the different embodiments or examples and the features of the different embodiments or examples can be combined by those skilled in the art.

Although explanatory embodiments have been shown and described, it would be appreciated by those skilled in the art that the above embodiments cannot be construed to limit the present disclosure, and changes, alternatives, and modifications can be made in the embodiments without departing from scope of the present disclosure.

What is claimed is:

1. A defrosting method for an air conditioner, wherein the air conditioner comprises a compressor and a four-way valve, and the method comprises:

acquiring outdoor temperature and outdoor humidity in response to determining that the air conditioner enters a defrosting mode;

judging whether the outdoor temperature is lower than a preset temperature and the outdoor humidity is higher than a preset humidity; and controlling an outdoor fan to rotate reversely according to tube temperature of an outdoor heat exchanger and a period when the air conditioner operates in the defrosting mode, so as to defrost a protecting housing surrounding the outdoor heat exchanger, in response to judging that the outdoor temperature is lower than the preset temperature and the outdoor humidity is higher than the preset humidity;

wherein controlling the outdoor fan to rotate reversely according to the tube temperature of the outdoor heat exchanger and the period when the air conditioner operates in the defrosting mode comprises:

controlling the outdoor fan to rotate reversely in response to determining that the tube temperature is higher than a difference between preset temperature for exiting from the defrosting mode and a first temperature threshold; or controlling the outdoor fan to rotate reversely in response to determining that the period when the air conditioner operates in the defrosting mode reaches a difference between a preset defrosting period and a first period threshold.

2. The defrosting method according to claim 1, before acquiring the outdoor temperature and the outdoor humidity, further comprising acquiring information of current weather, wherein if the current weather is at least one of raining and snowing, judging whether the outdoor temperature is lower than first preset temperature and the outdoor humidity is higher than first preset humidity; and if the current weather is neither the raining nor the snowing, judging whether the outdoor temperature is lower than second preset temperature and the outdoor humidity is higher than second preset humidity, wherein the second preset temperature is higher than the first preset temperature and the second preset humidity is lower than the first preset humidity.

3. The defrosting method according to claim 1, if the outdoor temperature is greater than or equal to the preset temperature and the outdoor humidity is lower than or equal to the preset humidity, the air conditioner is controlled by the controlling module to exit from the defrosting mode when the tube temperature of the outdoor heat exchanger is higher than preset temperature for exiting from the defrosting mode or the period when the air conditioner operates in the defrosting mode reaches preset defrosting period.

4. A defrosting device for an air conditioner, wherein the air conditioner comprises a compressor and a four-way valve, and the device comprises:

an acquiring module, configured to acquire outdoor temperature and outdoor humidity if the air conditioner enters a defrosting mode;

a controlling module, configured to judge whether the outdoor temperature is lower than a preset temperature and the outdoor humidity is higher than a preset humidity; and control an outdoor fan to rotate reversely according to tube temperature of an outdoor heat exchanger and a period when the air conditioner operates in the defrosting mode, so as to defrost a protecting housing surrounding the outdoor heat exchanger, in response to judging that the outdoor temperature is lower than the preset temperature and the outdoor humidity is higher than the preset humidity;

wherein the controlling module is further configured to:

control the outdoor fan to rotate reversely in response to determining that the tube temperature is higher than a difference between preset temperature for exiting from the defrosting mode and a first temperature threshold; or control the outdoor fan to rotate reversely in response to determining that the period when the air conditioner operates in the defrosting mode reaches a difference between a preset defrosting period and a first period threshold.

5. The defrosting device according to claim 4, wherein before acquiring the outdoor temperature and the outdoor humidity, the acquiring module is further configured to acquire information of current weather, wherein if the current weather is at least one of raining and snowing, the controlling module judges whether the outdoor temperature is lower than first preset temperature and the outdoor humidity is higher than first preset humidity; and if the current weather is neither the raining nor the snowing, the controlling module judges whether the outdoor temperature is lower than second preset temperature and the outdoor humidity is higher than second preset humidity, wherein the second preset temperature is higher than the first preset temperature and the second preset humidity is lower than the first preset humidity.

6. The defrosting device for an air conditioner according to claim 4, if the controlling module judges that the outdoor temperature is greater than or equal to the preset temperature and the outdoor humidity is lower than or equal to the preset humidity, the air conditioner is controlled by the controlling module to exit from the defrosting mode when the tube temperature of the outdoor heat exchanger is higher than preset temperature for exiting from the defrosting mode or the period when the air conditioner operates in the defrosting mode reaches preset defrosting period.

7. An air conditioner, comprising:

a compressor;

a four-way valve; and a defrosting device for defrosting the air conditioner, said defrosting device comprising:

an acquiring module, configured to acquire outdoor temperature and outdoor humidity if the air conditioner enters a defrosting mode;

a controlling module, configured to judge whether the outdoor temperature is lower than a preset temperature and the outdoor humidity is higher than a preset humidity; and control an outdoor fan to rotate reversely according to tube temperature of an outdoor heat exchanger and a period when the air conditioner operates in the defrosting mode, so as to defrost a protecting housing surrounding the outdoor heat exchanger, in response to judging that the outdoor temperature is lower than the preset temperature and the outdoor humidity is higher than the preset humidity;

wherein the controlling module is further configured to:

control the outdoor fan to rotate reversely in response to determining that the tube temperature is higher than a difference between preset temperature for exiting from the defrosting mode and a first temperature threshold; or control the outdoor fan to rotate reversely in response to determining that the period when the air conditioner operates in the defrosting mode reaches a difference between a preset defrosting period and a first period threshold.

8. The air conditioner according to claim 7, wherein before acquiring the outdoor temperature and the outdoor humidity, the acquiring module is further configured to acquire information of current weather, wherein if the current weather is at least one of raining and snowing, the controlling module judges whether the outdoor temperature is lower than first preset temperature and the outdoor humidity is higher than first preset humidity; and if the current weather is neither the raining nor the snowing, the controlling module judges whether the outdoor temperature is lower than second preset temperature and the outdoor humidity is higher than second preset humidity, wherein the second preset temperature is higher than the first preset temperature and the second preset humidity is lower than the first preset humidity.

9. The air conditioner according to claim 7, if the controlling module judges that the outdoor temperature is greater than or equal to the preset temperature and the outdoor humidity is lower than or equal to the preset humidity, the air conditioner is controlled by the controlling module to exit from the defrosting mode when the tube temperature of the outdoor heat exchanger is higher than preset temperature for exiting from the defrosting mode or the period when the air conditioner operates in the defrosting mode reaches preset defrosting period.

* * * * *